US006716256B2

(12) United States Patent
Umehara et al.

(10) Patent No.: US 6,716,256 B2
(45) Date of Patent: Apr. 6, 2004

(54) METHOD FOR PREPARATION OF SLENDERIZED ANIMAL FIBER

(75) Inventors: Ryo Umehara, Aichi-ken (JP); Takashi Kanda, Aichi-ken (JP); Masaru Yamada, Mie-ken (JP); Tadashi Karakawa, Osaka-fu (JP)

(73) Assignee: Kurabo Industries Ltd., Okayama-Ken (JP)

( * ) Notice: Subject to any disclaimer, the term of this patent is extended or adjusted under 35 U.S.C. 154(b) by 47 days.

(21) Appl. No.: 09/950,587

(22) Filed: Sep. 13, 2001

(65) Prior Publication Data

US 2003/0068493 A1 Apr. 10, 2003

(51) Int. Cl.[7] ..... D06M 15/71; D02G 3/30
(52) U.S. Cl. ..... 8/128.1; 57/254
(58) Field of Search ..... 524/62, 378, 591, 524/804, 386; 428/195, 200

(56) References Cited

U.S. PATENT DOCUMENTS

| | | | |
|---|---|---|---|
| 3,505,802 A | 4/1970 | Okada et al. | |
| 5,459,902 A | 10/1995 | Hino et al. | |

FOREIGN PATENT DOCUMENTS

| | | |
|---|---|---|
| EP | 0 632 149 | 1/1995 |
| JP | 44-15136 | 7/1969 |
| JP | 46-33141 | 9/1971 |
| JP | 5-500989 | 2/1993 |
| JP | 7-3556 | 1/1995 |
| JP | 3113651 | * 12/2000 |
| JP | 3200054 | 6/2001 |
| WO | 91/02835 | 3/1991 |

OTHER PUBLICATIONS

U.S. patent application Ser. No. 09/902,256 (Hisashi et al.).

Patent Abstracts of Japan, vol. 2000, No. 16, May 8, 2001 & JP 2001 003238 A (Kurabo Ind. Ltd.), Jan. 9, 2001.

* cited by examiner

*Primary Examiner*—John Hardee
(74) *Attorney, Agent, or Firm*—Wenderoth, Lind & Ponack, L.L.P.

(57) ABSTRACT

A slenderized crimped animal fiber with a fixed slenderized form having a lowering rate of tensile strength for undyed spun yarn of no less than 10%, fiber contraction in boiling water of no more than 1%, an alkali solubility of no more than 22% by weight and a UB solubility of no more than 35% by weight, wherein the slenderized crimped animal fiber is prepared by being drawn by practically 1.20 to 1.60 times after an anisotropic swelling is given to the animal fiber consisting of bilateral structure using swelling plasticization with base.

20 Claims, 4 Drawing Sheets

METHOD FOR PREPARATION OF SLENDERIZED ANIMAL FIBER

BACKGROUND OF THE INVENTION

1. Field of the Invention

The present invention relates to a slenderized animal fiber that is slenderized by drawing and maintains the resulted state temporarily or permanently, and a method for preparation thereof, and a spun yarn that is obtained by being mixed with said animal fiber.

2. Description of the Prior Art

Conventionally several attempts to apply a drawing treatment to an animal fiber have been made in order to make an bulky or lightweight animal fiber, to improve a heat retaining property and to manufacture a spun yarn of a finer yarn count. In Japanese Patent Publication No. Sho44-15136, a method is disclosed that after a wool top sliver is twisted in accordance with a twisting method of one-plied top sliver, two-plied top sliver and multiplied top sliver, the top sliver is given a drawing of 30% in an aqueous solution of a penetrating agent and a nonion surfactant at 70° C., and then the top sliver is drawn and set at 50° C. for one hour, and subsequently it is cooled in water and untwisted and dried. Since the object of the above-described processing is to set a state drawn temporarily, the crimps of the wool fibers are recovered by releasing the temporary set in a relaxing process followed.

In Japanese Patent Publication No. Sho46-33141, a method is disclosed that after the wool top slivers, in the case of sliver of 20 g/m, are given approximately 0.05 to 0.4 turns/cm of twist by a twisting method of one-plied top sliver, two-plied top sliver and multi-plied top sliver, the sliver is given a drawing of 30% in water at 100° C. and kept setting for approximately one hour in water, or the sliver is given a drawing of 20% in an aqueous solution of 2% of monoethanolamine bisulfite at 80° C. and kept setting for 40 minutes, and then the sliver is washed in water, untwisted, air-dried or dried to obtain latent contraction or latent crimps. However, this is not a method for decreasing fiber diameter of wool fiber and increasing fiber length.

In Japanese Patent Laid-Open No. Hei5-500989, a complicated drawing equipment and a drawing method by a false twisting method for forming slenderized wool staple fibers are indicated, and in this document it is described that 50 to 110 g/m of twistless sliver or roving is treated with a wetting agent 0.25 to 1 g/l and that as a plasticizer for producing a mercapto anion in protein fibers, 1 to 75 g/l of sulfite, bisulfite or meta-bisulfite of sodium, ammonium or potassium, an alkali itself, an alkali salt, sodium thioglycolate or ammonium thioglycolate are used. However, formation of a mercapto anion by the above-described method is possible only in an alkali side condition. Therefore, though it describes a drawing of protein fibers under existence of an alkali, a sufficient dipping time and a comparatively high temperature are required in order to make it plasticize. Under the conditions of the dipping time for about several seconds at low temperature, even if a sliver bundle is drawn by 100%, practically by 60%, single fiber breakage occurs and results in drawn sliver containing many short fibers. In the method of this document where in order to plasticize the protein fibers of the twistless sliver, the sliver is introduced into a dipping bath at the speed of 13.2 m/min, 3 m/min, or 6 m/min, twist factor of approximately 120 or 180 using a false-twist method well used in a spinning process of a synthetic fiber and stretched by 100%, and then reduction set by steam in a residence time of 2 minutes, and subsequently restored to a twistless state to oxidize in a hydrogen peroxide bath, and rinsed and dried, an oxidation/reduction set is given in order to stabilize a permanent set but a neutralization treatment with an acid or an base is not applied. Therefore, since the drawn protein fibers obtained are basic, the fiber has a tendency of yellowing in a following heating treatment.

In Japanese Patent Laid-Open No. Hei7-3556 a following method is disclosed; a twistless sliver of animal fibers of 30 mm or more in fiber length are dipped and treated in hot water of 80° C., or in an aqueous solution at 80° C. containing 1.0% by weight of thioglycolic acid and 1.5 mols of urea and adjusted to pH 2.5 with 25% of aqueous ammonia solution, or in aqueous solution at 80° C. containing 2.0% by weight of thioglycolic acid and 1.5 mols of urea and adjusted to pH 3.7 with 28% of aqueous ammonia solution, and then at first is drawn 1.05 times between six nip rollers respectively using nip rollers of a small diameter. Subsequently the sliver is drawn up to 1.49 times between the six nip rollers and simultaneously a reduction set is given by steaming treatment with a vapor pressure of 2 kg/cm$^2$. In the next process the sliver is oxidized with 1% of hydrogen peroxide in aqueous solution at pH 7, at 40° C., for 10 minutes using a top dyeing machine and then washed and dried in a back washer. However, since this method gives a roller drawing to the twistless sliver, it has several problems on processing operation such as especially a fiber wrapping on a roller surface, and slipping-off of a sliver by roller drafting system, a low productivity and a high cost associated with the above-described defect, for example.

SUMMARY OF THE INVENTION

In the case of natural wool fibers, their finest has a diameter of 15 to 16 microns. Since such wool fibers have an extremely little quantity of supply and are very expensive, an industrial technology that can supply such wool fibers at low cost has been desired. It is known that when a single fiber of animal fibers, especially wool fibers is fully swelled in water and drawn, it can be drawn up to from 50% to 60%. However, the method for obtaining a slenderized fiber by which the fiber length is increased and the extended state is permanently retained without damage of bilateral structure is not known. The present invention provides the above-described slenderized animal fiber with the properties of less-fiber contraction in boiling water, less solubility of alkali and high solubility of urea-bisulfite (UB) and the like, in addition to above-described properties, and the method for preparation thereof.

The present invention relates to a slenderized crimped animal fibers having a lowering rate of reduction percentage of tensile strength for undyed spun yarn no less than 10% fiber contraction in boiling water of no more than 1%, alkali solubility of no more than 22% by weight and UB solubility of no more than 35% by weight, wherein the slenderized crimped animal fibers are prepared by being drawn by practically 1.20 to 1.60 times after an anisotropic swelling is given to the animal fibers consisting of bilateral structure using basic plasticizing and swelling agents.

And the present invention relates to a method for preparation of the above-described slenderized crimped animal fiber, comprising steps of:

a) a process wherein an actual twist is applied to an animal fiber sliver;
b) a process wherein a twisted animal fiber sliver is swelled and plasticized by a basic aqueous solution and subsequently an anisotropic swelling is given to the animal fiber consisting of a bilateral structure;

c) a reduction process wherein a disulfide bond in the anisotropically swelled and plasticized fiber is cleaved;

d) a drawing process wherein the reduced and anisotropically swelled and plasticized fiber is drawn by practically 1.20 to 1.60 times;

e) a process wherein the drawn animal fiber is oxidized to reproduce a disulfide bond;

f) a process wherein the fiber is neutralized with an acid to be de-swelled;

g) a drying process in an tentionless condition, wherein the dipping and squeezing is repeated using at least each three pairs of squeezing rollers provided in each of an oxidation treatment bath, a neutralization treatment bath and hot water washing baths installed before and after the preceding two baths respectively and the oxidation treatment is conducted at 15 to 25° C.

Further, the present invention relates to a slenderized animal fiber being in a state of temporarily fixed slenderized form with a crimp-recovering property by de-swelling treatment with acid and wet heat treatment, having a lowering rate of reduction percentage of tensile strength for undyed spun yarn of no less than 10%, fiber contraction in boiling water of completely recover level where the fiber subjected to elongation of 1.20 to 1.30 times recovers the original length, an alkali solubility of no more than 15% by weight and a UB solubility of no more than 40% by weight, wherein the slenderized animal fiber is prepared by being drawn by practically 1.20 to 1.30 times after an anisotropic swelling is given to the animal fiber consisting of bilateral structure using basic swelling and plasticizing agents.

Moreover, the present invention relates to a method for preparation of the above-described slenderized animal fiber, comprising steps of:

a) a process wherein an actual twist is applied to an animal fiber sliver;

b) a process wherein a twisted animal fiber sliver is swelled and plasticized by a basic aqueous solution and subsequently an anisotropic swelling is given to the animal fiber consisting of bilateral structure;

c) a reduction process wherein the anisotropically swelled and plasticized fiber is drawn by practically 1.20 to 1.30 times;

d) a process wherein the fiber is neutralized with an acid to be de-swelled;

e) a drying process in a stretched condition, wherein the dipping and squeezing is repeated using at least each three pairs of squeezing rollers provided in each of a neutralization treatment bath and hot water washing baths installed before and after the preceding two baths respectively and the neutralization treatment is conducted at 15 to 25° C.

In more detail the present invention relates to the method for preparation of the above-mentioned slenderized animal fiber, wherein the anisotropic-swelling and plasticization treatments are performed by dipping the twisted animal fiber sliver in a basic aqueous solution of pH 7.6 to 10.5 containing a swelling agent and a plasticization agent for 5 to 40 minutes at 30 to 80° C.

In addition, the present invention relates to a method for preparation of a bulky animal fiber spun yarn, wherein the above-described slenderized animal fiber is mixed with un-drawn animal fiber and spun, and then by relaxation, an original length of a temporarily fixed animal fiber is recovered.

DETAILED DESCRIPTION OF THE INVENTION

Figure 1:
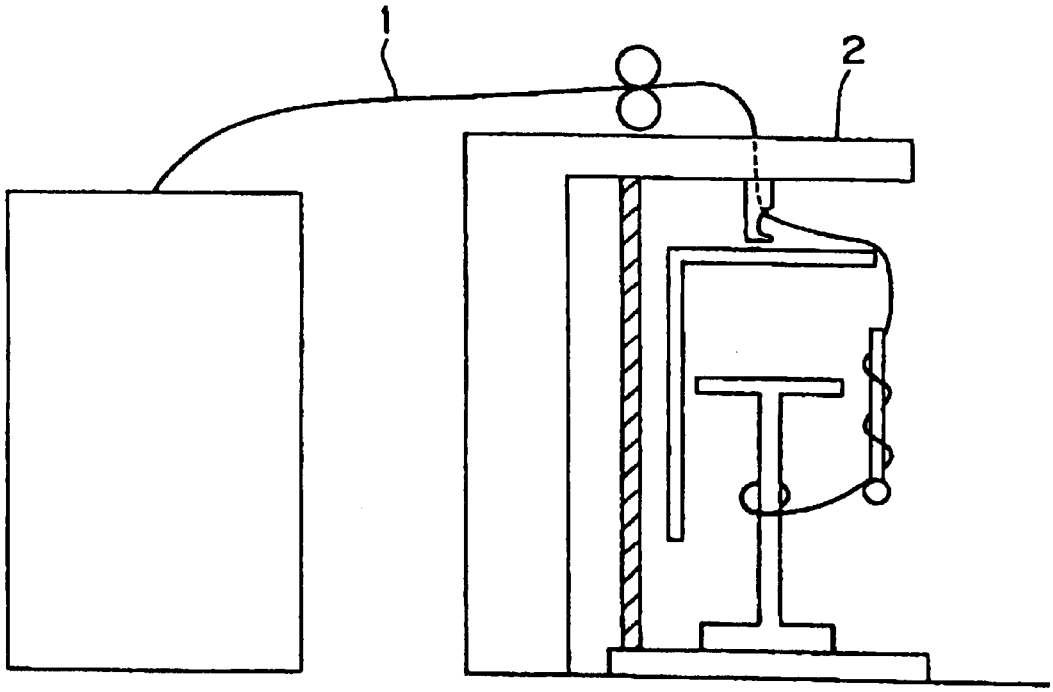
FIG. 1 is a schematic view of a twisting process for manufacturing a slenderized animal fiber, and of one example of an equipment used in the present invention.

The slenderized animal fiber of the present invention is the fiber in which a slenderized animal fiber is drawn practically 1.20 to 1.60 times or 1.20 to 1.30 times and as the result the slenderized state is fixed temporarily or permanently. In one embodiment, the slenderized animal fiber of the present invention is a fiber having a slenderized form that is in a substantially permanently fixed state and having a fineness that cannot be found in natural animal fibers, and besides having an intrinsic crimps of natural animal fiber. Moreover, in another embodiment, a slenderized state of the slenderized animal fiber of the present invention is fixed temporarily and the fiber can recover a crimp by relaxation treatment.

Usually, when a fiber is drawn, a perfect plastic deformation never occurs and a total deformation contains partially an elastic deformation, and therefore the portion of an elastic deformation recovers its original form after drawing. Accordingly, an applied drawing magnification differs from a practical drawing magnification that remains in fiber. In the present invention, since these two magnifications are to be distinguished, a actual drawing magnification of the twisted fiber bundle is represented by adding "practical".

Moreover, a state that "a slenderized form is fixed permanently" means that the slenderized form is not substantially lost by a general treatment or processing of fibers such as spinning process and dyeing process.

In addition, a state that "a slenderized form is fixed temporarily" means that since the slenderized form is not fixed permanently or semi-permanently the slenderized form has a possibility of being lost by a relaxing process in some case.

Moreover, a "crimp recovering property" means that an animal fiber can recover a crimp that it has originally had, by relaxation processing.

As relaxing processing for giving a crimp recovery and releasing from a slenderized state fixed temporarily, a processing by warm water, hot water, steam, etc. is mentioned. Especially a method for relaxation processing by hot water or steam is preferable.

A treatment of plasticization and swelling of the animal fiber is the most important process in the present invention to carry out a drawing processing smoothly and to fix slenderized state permanently and constructs the very essence of a method for manufacturing slenderized animal fiber of the present invention. Hereinafter, a technology and a thought that makes the base of the present invention will be described.

1) An animal fiber consists of a cellular tissue that has a spindle form, and consists of a para-cortex that consists of a dense tissue and an ortho-cortex that consists of a tissue with lower density and lower regularity. Therefore, the para-cortex has a higher density (higher than 1.280) than the ortho-cortex (lower than 1.280) and has a bilateral structure and a deep relation to the formation of a crimp. The para-cortex always constructs the inside of a crimp curve, and on the other hand, the ortho-cortex constructs the outside. And the ortho-cortex ocupies quantitatively bigger portion than the para-cortex. The ortho-cortex is easily dyed with basic dyes, and on the other hand, the para-cortex is easily dyed with acid dyes. From this point of view, the ortho-cortex is basophilic and a para-cortex is acidophilic. When an animal fiber is dipped in an aqueous solution of basic reagents such as sodium hydroxide, sodium carbonate or an organic amine and the like, the basic reagents are naturally absorbed selectively by the basophilic ortho-cortex rather than by the acidophilic para-cortex (i.e. an anisotropic swelling occurs.) and the ortho-cortex is swelled by approximately 2 times in a lateral direction of the fiber. And as the result, a relaxation occurs in the bond of a macromolecule chain of keratin protein. The present invention comes from full use of these phenomena.

2) As the para-cortex includes more cystine than ortho-cortex, the para-cortex naturally has a higher cystine cross-link density, and therefore the para-cortex is difficult to be plasticized and swelled. However, the cleavage of a cystine cross-link bond using reducing agents such as sodium bisulfite that cleaves the cystine cross-link can increase the drawing property of the fiber. The cleaved cross-link is cross-linked again using an exchange reaction of cystine/cysteine (—SS—/—SH) by an action of an oxidizer in the process after drawing, and as a result the structure of the slenderized animal fiber is fixed.

3) In order to slenderized wool fiber, a high drawing of substantially 1.2 to 1.6 times is necessary to be applied, and therefore a plasticization and swelling processing should be performed carefully at high temperature and for a long time. A dipping in an aqueous solution of plasticizing and swelling reagents at ordinary temperature for several seconds can not give sufficient drawing to the fiber, but many fibers are broken down. Consequently the method brings out a result of manufacturing the drawn sliver with large content of many short fibers.

4) Since a plasticizing and swelling processing is a process performed under basic condition, a neutralization processing is an essential condition in order to stabilize polypeptide structure of a keratin protein molecules. And a balancing of an acidic and a basic treatment is the necessary and sufficient conditions in order to stabilize this structure more. Therefore, the more basic chemicals or reagents is used, the more acidic chemicals or reagents is necessary to be used.

5) The cortical cell of an animal fiber is a spindle-like cell. The length of the spindle-like cell of the ortho-cortex is longer than the that of the para-cortex a little, and this difference of the length affects the curve of crimps. By reduction processing under basic condition, the cell is extremely swelled in the lateral direction in the side of the ortho-cortex, and, as a result, is contracted in the length direction. By de-swelling of the ortho-cortex by neutralization with an acid, the ortho-cortex is contracted in the lateral direction by de-swelling and simultaneously elongated in length direction. Both of the length and crimp will recover to original state.

6) When an oxidation treatment is applied after giving actual twist to an animal fiber sliver, dipping the sliver in a plasticization and swelling aqueous solution and then drawing to high extent, the transversal pressure is added to each fiber in said bundle of fibers owing to a high twist and a high drawing. Consequently, the fibers are deformed to have a flat shape. Cement materials between cell having a soluble protein with low systine flow out of the inside of the fiber, and covers the surface of the fiber to cause a decrease of a luster of the surface.

Moreover, when the cementing materials are dried, each fiber of the animal fiber bundle will be adhered again, the fiber bundle is stiffened, and subsequently the separation between fibers by a gilling becomes very difficult and therefore the fiber breakage is taken placed. In this stage, by both treatments with a swelling agent and an acid as a modifier for a protein, for example, formic acid, the cementing materials covering the fiber surface is removed to recover a luster of the surface. This processing by acid, such as formic acid, is an epoch-making system that can also provide a simultaneous effect of neutralizing the above-described reducing process under basic condition.

As animal fiber used in the present invention, a fiber comprising protein fiber, such as wools, mohair, alpaca, cashmere, llama, vicuna and camel are mentioned. In particular, wools, mohair, and an alpaca are preferable.

The manufacturing methods of the present invention including the process for the first embodiment of the slenderized animal fiber in which the slenderized form is fixed permanently, and a second embodiment of slenderized animal fiber in which the slenderized form is fixed temporarily and has a crimping property, are explained by following the process.

A slenderized animal fiber can be manufactured by the process of the following a) to g);

a) a process wherein an actual twist is applied to an animal fiber sliver;
b) a process wherein a twisted animal fiber sliver is swelled and plasticized by a basic aqueous solution;
c) a reduction process wherein a disulfide bond in swelled and plasticized fiber is cleaved;
d) a drawing process wherein a swelled and plasticized fiber that is reduced is drawn by practically 1.20 to 1.60 times;
e) a process wherein a drawn animal fiber is oxidized by an oxidizing agent;
f) a process wherein the fiber is neutralized with an acid;
g) a drying process in a relaxed state.

Moreover, the present invention is characterized in that the dipping and squeezing are repeated using at least each three pairs of squeezing rollers provided in each of an oxidation treatment bath, a neutralization treatment bath and hot water washing baths installed before and after the preceding two baths respectively and the oxidation treatment is conducted at 15 to 25° C.

A superior slenderized animal fiber, which has never been obtained before, having a lowering rate of reduction percentage of tensile strength for undyed spun yarn of no less than 10%, fiber contraction in boiling water of no more than 1%, an alkali solubility of no more than 22% by weight and UB solubility of no more than 35% by weight, is obtained by using the above-described squeezing rollers and by performing an oxidation at low temperature of 15 to 25° C. Here, a lowering rate of reduction percentage of tensile strength means that of tensile strength of the treated fiber based on tensile strength of untreated animal fiber.

In general, in order to remove the processing agents and residuals at the preceding process, it is preferable to provide a washing process, preferably a washing process by warm water, after a drawing process, an oxidation process, and a neutralization process. When a warm water washing is performed, a fiber is preferably treated in stretched state in order to prevent the relaxed structure from shrinking by the heat of the warm water.

In the first process, actual twist is given to an animal fibers in the sliver state. By giving the actual twist to the sliver in advance of drawing, a fiber wrapping to a roller surface, and slipping-off of a sliver can be prevented to avoid a decrease in productivity caused by these troubles.

In the present invention a twisting method and a type of a twister do not have any limitation in particular. In the case where actual twist is given to wool fiber sliver using Flyer twister, for example, the weight of sliver is adjusted to about 20 to 40 g/m, for example, about 37 g/m, and it is desirable that 16 turns/m to 25 turns/m of actual twist is given. In mohair and an alpaca, since fiber itself has a poor cohesion, a twist of about 20 turns/m to 30 turns/m is required for the sliver of about 37 g/m, for example.

At the second process, the twisted animal fiber sliver is subjected to a swelling and plasticization by base. As described above, an animal fiber is contracted in the length direction according to a swelling plasticization that increases the diameter. The outer side of crimp of animal fiber consists of an ortho-cortex component, and, on the other hand, the inner side of a crimp mostly consists of a para-cortex component, and they form a bilateral structure. Moreover, since an ortho-cortex has more affinity to a basic reagents, a swelling and plasticization by a basic reagents take place more greatly in the ortho-cortex (anisotropic swelling). Therefore, when a basic reagents is used as a swelling agent, the ortho-cortex which is in the outside of the crimp swells more in the lateral direction of the fiber, and conversely the fiber contracts in the length direction. And therefore, the crimp is lost and the fiber becomes to have a shape of a straight line or a form similar to it.

In the present invention, as for the degree of required swelling, it is preferable that a degree of swelling in volume is at least 2.0 times, and more preferably 2.0 to 2.5 times, and the most preferably 2.0 to 2.1 times.

The examples of useful swelling agent in the present invention are a carbonate of sodium, ammonium or potassium, sodium hydroxide, and potassium hydroxide.

Moreover, the examples of plasticization agent are amines, such as monoethanolamine and diethanolamine. These agents may be used independently or in combination.

Preferably, the aqueous solution containing both monoethanolamine at the concentration of 1 to 3 g/l and sodium hydroxide at the concentration of about 8 to 13 g/l for adjusting pH to 7.5 to 9.0 is used. Particularly preferably, the aqueous solution containing monoethanolamine at the concentration of 2 g/l and sodium hydroxide at the concentration of 10 g/l is used. These aqueous solutions are used in large excess to the processed animal fiber or the processing agent is always supplied to an aqueous solution so that the concentration of the aqueous solution is kept constant. Dipping temperature is in the range from 30 to 60° C., preferably 40° C., and dipping time is in the range from 20 to 50 minutes, preferably 30 minutes.

In advance of drawing, the swelled and plasticized animal fiber is subjected to a reduction processing in order to cleave a disulfide bond "—S—S—" in the cortex. The examples of reducing agents that can be used for the reduction processing are sulfite, bisulfite or meta-bisulfite of sodium, potassium or ammonium, sodium thioglycolate, ammonium thioglycolate, monoethanolamine sulfide, and monoethanolamine bisulfide. Preferably sodium bisulfite or sodium sulfite can be used. The condition of reduction processing by these reducing agents varies with the type and the concentration of the reducing agent, and it is usually for 1 to 3 minutes at 60 to 100° C., preferably for 1 to 2 minutes at 80 to 100° C. Moreover, the concentration of the reducing agent in an aqueous solution is 10 to 50 g/l, preferably 20 to 40 g/l.

The degree of the reduction is preferably of the level where at least 25% of all disulfide bonds, and more preferably 25 to 40% is cleaved. The most preferably it is 25 to 30%.

In manufacturing of the slenderized animal fiber of the second embodiment of the present invention, the swelled and plasticized animal fiber sliver is subjected to drawing process directly without this reduction process.

The animal fiber fully subjected to the plasticizing and swelling processing or further subjected to the reduction processing is subsequently drawn at actual draw ratio of no less than 1.20, preferably of 1.20 to 1.60 and still preferably of 1.30 to 1.60. If the drawing is performed in hot water at 80 to 100° C. or in steam at 90 to 95° C., the drawing can be carried out with a little fiber breakage in roving. The drawing can be performed between the rollers that rotate at different surface speed. The drawing needs to be not necessarily performed in one stage but may be performed in many stages. Generally a drawing performed in latter enables a more stable and high draw ratio.

In order to remove swelling and plasticizing agents and reducing agents, the animal fiber after drawn is usually washed in warm or hot water at 30 to 60° C. or preferably of 45 to 50° C. It is preferable that the washing is performed under stretched condition so that the drawing state may not be relaxed. In hot water washing processing, hot water is made to impregnate repeatedly into animal fiber and subsequently squeezed using at least three or more squeezing roller pairs. This leads to sufficient washing effect and enables a high performance in the following oxidation process.

The animal fiber after drawn and washed by hot water is treated with oxidizer in order to equilibrate the oxidation-reduction state in fiber, namely so that cystine/cysteine (—SS—/—SH) ratio is balanced in the range from 900 ($\mu$mol/g wool)/10 ($\mu$mol/g wool) to 700/50, preferably from 800/10 to 700/30. The ratio differs more or less according to sheep types. If much amount of fiber is reduced, it is naturally necessary also to increase the amount of oxidation, and thus balanced reduction/oxidation ratio enables a chemical set permanently fixed. This treatment re-constructs the "—S—S—" cross-linking broken in the previous reduction process and the cross-link state almost close to the state of untreated fiber is formed.

In oxidation processing, the oxidizer is made to impregnate repeatedly into the animal fiber and subsequently squeezed using at least three squeezing-roller pairs. Thus the effective and sufficient oxidation processing enables a treating performed at a low temperature of 15 to 25° C. Because a sufficient impregnation and an oxidation treatment at low temperature are applied to the animal fiber by the squeezing rollers, the fiber suffers little damage and consequently excellent slenderized fiber is obtained with a lowering rate of reduction percentage of tensile strength for undyed spun yarn of no less than 10%, fiber contraction in boiling water of no more than 1%, an alkali solubility of no more than 22% by weight and UB solubility of no more than 35% by weight.

As oxidizer, hydrogen peroxide, potassium bromate, sodium bromate, sodium borate, potassium borate, etc. can be used. Hydrogen peroxide is preferable.

Hydrogen peroxide is preferable because the residual portion remaining in the fiber is easily removed. When using hydrogen peroxide as an oxidizer, the concentration of the hydrogen peroxide in an aqueous solution is preferably 1 to 3 weight %, and more preferably 2.8 weight %.

In the case where, for example, hydrogen peroxide concentration is 2.8 weight %, the processing time is 90 to 150 seconds, and preferably 120 seconds at 15 to 25° C.

Naturally the oxidation processing is not necessary in the second embodiment for the slenderized animal fiber not containing without reduction treatment.

Usually, the animal fiber subjected to the above-described processing by the oxidizer is washed with hot or warm water of 40 to 60° C. in order to remove the oxidizer in the fiber. In this washing processing, impregnation of water into the animal fiber and subsequently squeezing are also conducted using at least three or more squeezing roller pairs in order to increase the removing efficiency of the oxidizer.

Then the animal fiber is subjected to a neutralization processing by an acid in order to neutralize the basic materials remaining, and to remove subsequently the soluble protein deposited on the fiber surface which bleeds out from the inside of the fiber in the drawing process.

Also in the neutralization processing, at least three or more squeezing roller pairs are used in order to accelerate and complete the neutralization more perfectly.

As neutralizer, inorganic acid such as hydrochloric acid and sulfuric acid, and organic acid such as acetic acid, formic acid and oxalic acid are preferable. Formic acid is especially preferable. The processing conditions of dipping and washing for 40 to 80 seconds in the solution of pH 2.0 to 4.5 is preferable at ordinary temperature. If it is washed under a preferable condition, at ordinary temperature for 30 seconds in a formic acid aqueous solution of pH 2.5, the basic chemicals contained in this fiber will be neutralized and simultaneously the soluble protein bleeding out of the inside of the fiber is also removed, and as a result a lustrous slenderized fiber is obtained.

In the slenderized animal fiber of the first embodiment, after neutralized and washed an actual twist of the fiber is cancelled and, the fiber is dried under no tension. The animal fiber that has been swelled in the lateral direction and contracted in the length direction constracts in the lateral direction and simultaneously is elongated in the length direction since a swelling state is cancelled as it dries. In this way, while the fiber is slenderized, a swelling is not performed uniformly in the animal fiber that has a bilateral structure. Since the swelling was performed more notably in the ortho-cortex side of the section of animal fiber, i.e., in the outside portion of the original crimp of the animal fiber, the extension degree in the length by a de-swelling is also larger in the ortho-cortex side. Accordingly, a crimp is recovered by the de-swelling so that the ortho-cortex side may become outside. Thus, the slenderized animal fiber with crimp is formed without actual length varied.

By the above process operation, although depending on the kind of animal fibers, fiber diameter decreases by about 15 to 20%, and fiber length increases by about 35 to 45%.

In the slenderized animal fiber of the second embodiment, after neutralized and washed, an actual twist of the sliver is un-twisted cancelled and then the fiber is dried under tension. While a swelling state is cancelled with drying, since the fiber is under the tension the fiber is formed with a slenderized state having a crimping recovery ability without producing crimps. Since the slenderized animal fiber obtained thus of the second embodiment has a crimping property, if relaxation processing is performed under no tension, the residual strain is cancelled and a crimp appears. The preferable relaxation processing for providing crimps is a heating and humidifying processing in steam or hot water. Especially preferable processing is relaxation processing in steam.

Figure 2:
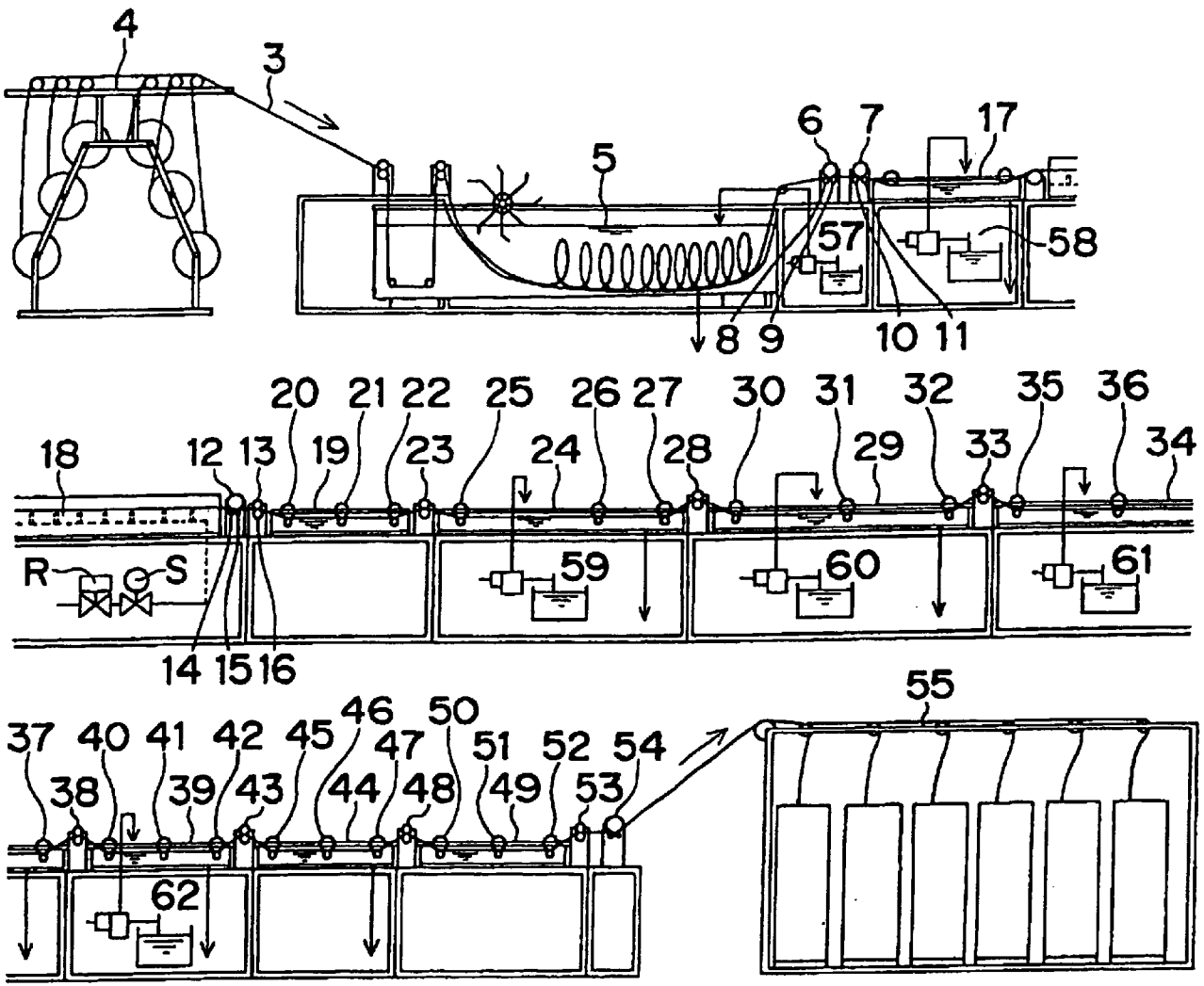
FIG. 2 is a schematic view of a manufacturing process and an apparatus used in the present invention.

Hereinafter, based on attached drawings as examples, the present invention will be explained still in detail. FIG. 1 to FIG. 4 are schematic views of the slenderizing process of an animal fiber. An actual twist of 16 turns/m in the direction of Z is given to an animal fiber sliver (1) by Flyer type twister (2), and the twisted sliver is rolled up to a bobbin (FIG. 1). As shown in FIG. 2, after the twisted animal fiber sliver (3) is loaded on a creel (4), it is pulled out and introduced into a pretreatment bath (5) for plasticizing and swelling. The plasticized and swelled animal fiber are nipped by a nip roller groups which consists of top rollers (6) and (7), and bottom rollers (8), (9), (10) and (11). Between this nip roller groups and the nip roller groups which consists of top rollers (12), (13), and bottom rollers (14), (15) and (16), the animal fiber is drawn using the difference of the rotation speed of the both roller groups, while passing through a reduction processing bath (17) and a steam processing machine (18) installed between the roller groups. Using this equipment the drawing magnification can be varied from 1.4 times (practically 1.20 times) to 2.5 times (practically 1.80 times) with speed ratio. Next, the drawn animal fiber is introduced into the hot water washing bath (19), and in order to avoid a usually generated relax within the hot water washing bath, the sliver is drawn by about 1.01 times between a roller (13) and a roller (23).

Figure 3:
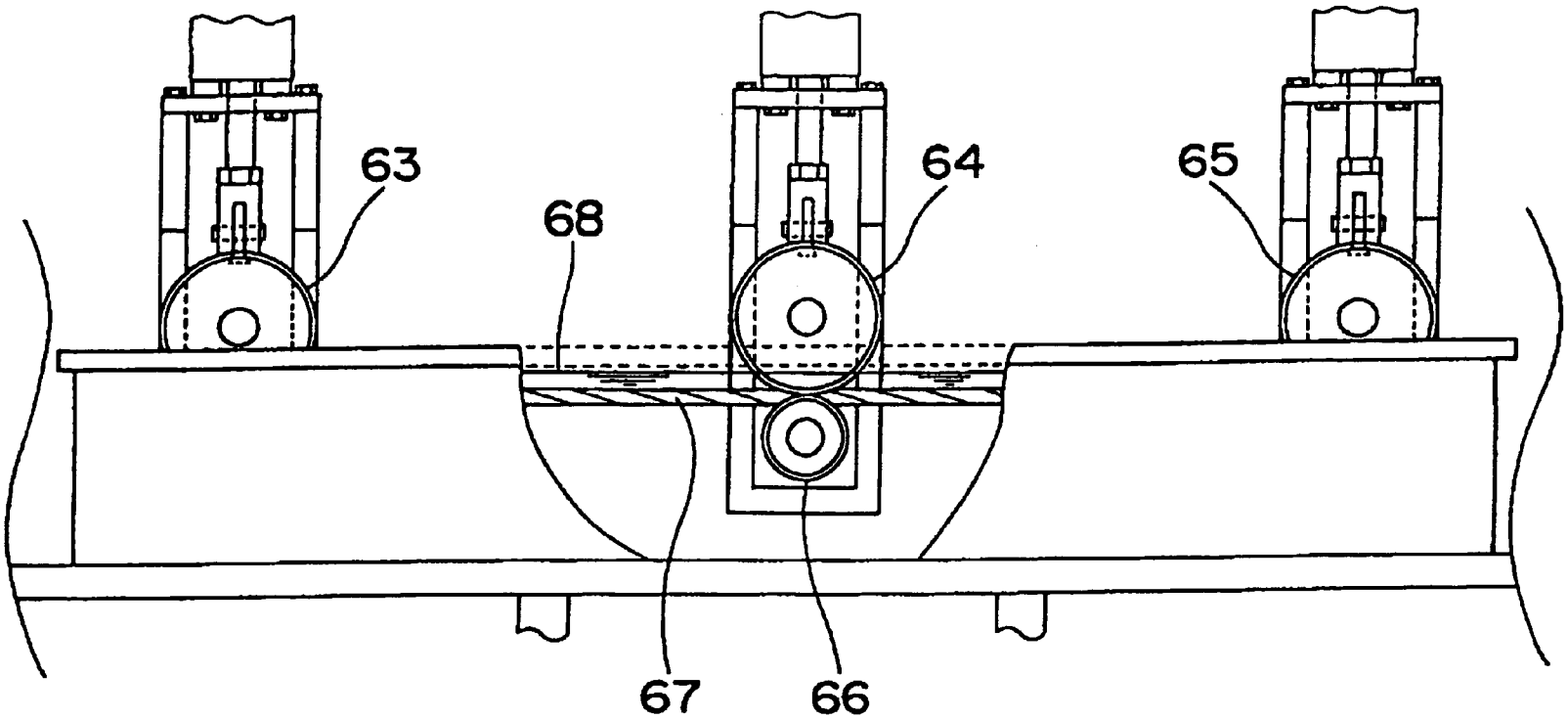
FIG. 3 is a schematic view of the squeezing roller in a processing bath.
Figure 4:
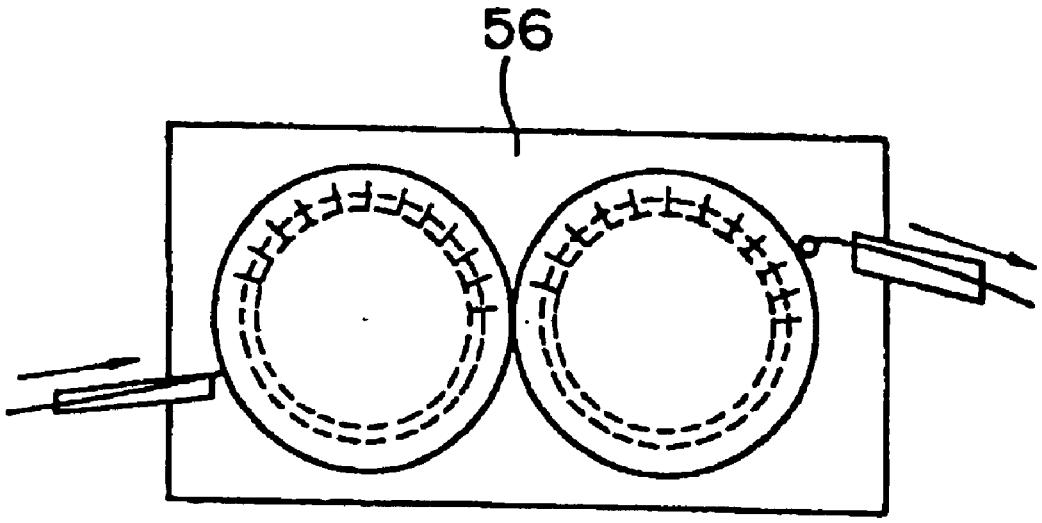
FIG. 4 is a schematic view of a drying process in a method for manufacturing a slenderized animal fiber and of one example of an equipment used in the present invention.

And then, the sliver is introduced into the oxidation baths (24), (29), and (34), and subjected to an oxidation treatment, drawing by about 1.01 times in each oxidation bath between rollers (23) and (28), (28) and (33), and (33) and (38), and, then sent to a neutralization bath (39). The sliver is also drawn by about 1.01 times between rollers (38) and (43) in neutralization bath. The fiber that is allowed to neutralize is introduced into hot water washing baths (44) and (49). The sliver hold at a state where the strain is slightly applied by being drawn by about 1.01 times between the rollers (43), (48), and (48), (53) in a hot water washing bath. Further it is drawn by 1.01 times between rollers (53) and (54) followed by canceling of the actual twist by a coiler type untwister (55) and drying. When drying under no tension, a suction type dryer (56) as shown in FIG. 3 is used.

In the above-described process, one top roller pairs with two bottom rollers, and a load of 600 to 1000 kg is applied to the both ends of the rollers, that is, the top roller (6)/the bottom rollers (8), (9); the top roller (7)/the bottom rollers (10), (11); and the top roller (12)/bottom rollers (14), (15) respectively. The diameter of the top rollers (6), (7) and (12) is 80 mm for example, and it is preferable for the surface to be covered with a rubber layer which has a hardness around 80 degrees. As bottom rollers, the roller made of stainless steel having grooves carved in the transverse direction on the surface is preferable. Thus, the roller has a structure to prevent slipping out even in case the roller draws sliver by 1.4 to 2.2 times (practically, 1.20 to 1.60 times) by roller drawing. The pretreatment bath (5) is equipped with a supply tank (57) of such processing solution, and a metering pump supplies a treating agent. And, the same liquid as in the pretreatment bath (5) is supplied from a supply tank (58) by a metering pump to the reduction processing bath (17). Furthermore, the oxidation baths (24), (29), and (34) are equipped with supply tanks (59), (60), (61), and metering pumps, and the neutralization bath (39) is equipped with a supply tank (62) and a metering tank.

In the first embodiment the animal fiber sliver is plasticized and swelled in the pretreatment bath (5) under in basic condition so that it can be highly drawn. And in the reduction processing bath (17) containing the above-mentioned reducing agent and the steamer (18), the cystine crosslink bond of an animal fiber is cleaved with this reducing agent, and is drawn by about 1.4 to 2.2 times (practically, 1.20 to 1.60 times) to be slenderized. The cystine cross-link is recoverd by an oxidation with oxidizer in the oxidation baths (24), (29), and (34), and as a result the molecular structure of the animal fiber protein is stabilized in the state where the fiber is slenderized. In the neutralization bath (39) the base absorbed in the animal fiber is neutralized to near neutral state by formic acid etc., and at the same time the soluble protein that elutes on this fiber surface and covers the surface of the fiber is removed and those processes result in the production of a slenderized fiber with a crimp recovering property and a high level luster.

In the second embodiment, in the plasticizing and swelling pretreatment process (5), a is buffer solution is prepared using sodium bicarbonate 1 g/l, and sodium carbonate 0.15 g/l, and pH of the bath is adjusted about 9.0., in the processes explained in detail using the above described Figures. The animal fiber sliver is then dipped in this prepared buffer solution at 30 to 70° C., preferably at 40 to 60° C. and more particularly at 60° C., for 5 minutes to 30 minutes, preferably for 10 minutes.

Furthermore, the steam processing (18) of the animal fiber sliver is carried out for 1 to 3 minutes, at 95° C. preferably, for 2 minutes, without using the reduction processing bath (17) (using an empty bath). Next, in the neutralization processing (39) a neutralization is performed with acetic acid etc. at pH 3 to 5, preferably at pH 4.0 to 4.5, and then the sliver is untwisted and dried.

The animal fiber sliver obtained thus is in the state of a temporary set without a permanent set but with a latent contraction stretched and fixed temporarily. When the sliver is treated with steam, heat or boiling water, the sliver recovers its original length. A bulky animal fiber spun yarn with volume may be obtained using the above-described property. And the animal fiber with a latent contraction may be mixed and spun with other fiber, such as, polyester, polyamide, acrylics, and cotton. Subsequently, when the obtained spun yarn is processed with water at warm or high temperature, the spun yarn comprising of fibers with latent contraction inside contracts to its original length, and as a result a bulky spun yarn with volume as a whole yarn may be obtained. The yarn of the present invention when knitted or woven may provide a light and bulky animal fiber products.

DESCRIPTION OF THE PREFERRED EMBODIMENTS

EXAMPLES

Although the present invention will be explained more concretely hereinafter by showing examples and comparative examples, the present invention is not limited by the following examples, and various suitable modifications and applications within the above-mentioned scope of the present invention is included within the technical range of the present invention

Example 1

The process chart indicated to the FIG. 1 is followed. The wool top sliver obtained by twisting by 16 turns/m a Merino wool top sliver of 37 g/m (1) having an average fiber diameter of 18.7 microns and an average fiber length of 77.2 mm (the longest fiber length of 150 mm) was introduced into the pretreatment bath (5) at the rate of 1.3 m/min, and subjected to a plasticizing and swelling processing for 30 minutes at 40° C. in the processing liquid of the following composition.

| | | |
|---|---|---|
| Sodium bisulfite | 30 g/l | |
| Monoethanolamine | 2 g/l | |
| Sodiumhydroxide | about 10 g/l | (the processing liquid adjusted pH 8.0) |

Next, the sliver was introduced into the reduction bath (17) which contains a solution of the same composition as the above-described pretreatment bath solution, and further plasticized and swelled at 80° C., for 30 seconds, and then treated by a steam processing for 95° C. for 70 seconds in the steamer (18). Simultaneously, the sliver allowed to draw by 2.1 times (practically 1.40 times) with the roller groups (12) and (13) having the surface speed of 2.1 times to the one of the roller groups (6) and (7). Then the sliver was washed in the warm water washing bath (19) with warm water at 25° C. for 30 seconds.

In this treatment, the sliver is repeatedly subjected to squeezing/dipping in the processing liquid by the squeezing rollers (20), (21) and (22) installed in the bath. Thus a sufficient liquid displacement effect was acquired. Then, in the oxidation baths (24), (29) and (34) in which the squeezing roller pairs (25), (26) and (27); (30), (31) and (32); (35), (36) and (37) were similarly installed, an oxidation treatment was performed at 25° C. for 40 seconds in each processing bath using 2.8 weight % of hydrogen peroxide aqueous solution. Also in this process the wool top sliver subjected to a sufficient oxidation action by a liquid displacement effect with the squeezing roller pairs in the baths as in the above-mentioned warm water washing bath. After that, in the neutralization bath (39) in which the squeezing roller pairs (40), (41) and (42) were similarly installed, a neutralization treatment was performed at 25° C. for 30 seconds using a aqueous solution adjusted to pH 2.5 with formic acid and then a warm water washing was performed at 25° C. in the hot water washing baths (44) and (49) in which the squeezing roller pairs (45), (46) and (47); (50), (51) and (52) were similarly installed. Also in this neutralization and warm water washing baths, a sufficient neutralization and warm water washing effect were acquired by the liquid displacement effect with the roller pairs installed in the baths as in the above-mentioned hot water washing baths and the oxidation baths. Finally, the sliver was untwisted using a coiler type untwister and dried by the suction drum dryer (56).

The drawn wool fiber sliver obtained by the above-mentioned method was gilled and recombed to obtain the result shown in Table 1.

The above-described drawn wool fiber sliver was proved to be modified to slenderized, and a white and lustrous wool fiber with a crimp.

TABLE 1

| | untreated wool top sliver | drawn wool top sliver of the present invention (Example 1) |
|---|---|---|
| average fiber diameter (μm) | 18.7 | 15.8 |

TABLE 1-continued

| | untreated wool top sliver | drawn wool top sliver of the present invention (Example 1) |
|---|---|---|
| average fiber length (mm) | 77.2 | 93.3 |
| length of longest fiber (mm) | 150 | 230 |
| content of short fiber (≦30 mm) (%) | 10.2 | 12.2 |
| alkali solubility (%) | 13.0 | 21.5 |
| UB solubility (%) | 52.6 | 35.8 |

The above-described drawn wool fiber was also spun to obtain a yarn with yarn count of 1/30 and twist of Z 440 as shown in Table 2. It is because of the decrease of fiber diameter and the increase of the number of fibers constructing a yarn with the slenderizing treatment that the tensile strength of the yarn does not so much decrease compared with untreated one.

TABLE 2

| characterization of spun yarn | method of examination | Example 1 | untreated |
|---|---|---|---|
| strength (gf) | JIS-L-1095 | 260.0 | 273.0 |
| elongation (%) | JIS-L-1095 | 12.8 | 21.2 |
| contraction in boiling water (%) | JIS-L-1095 A | 0.6% | 0.9 |

Comparative Example 1

After as comparison for Example 1 the processing was performed according to the processing conditions of Example 1 except for that the squeezing rollers currently installed in each of the oxidation baths were not used, the sliver was gilled and recombed to obtain the result shown in Table 3.

TABLE 3

| | drawn wool top sliver of Example 1 | drawn wool top sliver of Comparative Example 1 |
|---|---|---|
| average fiber diameter (μm) | 15.8 | 16.1 |
| average fiber length (mm) | 93.3 | 85.9 |
| length of longest fiber (mm) | 230 | 200 |
| content of short fiber (≦30 mm) (%) | 12.2 | 12.5 |
| alkali solubility (%) | 21.5 | 22.8 |
| UB solubility (%) | 35.8 | 32.9 |

And the above-described drawn wool fiber was spun to obtain a yarn with yarn count of 1/30 and twist of Z 440 as shown in Table 4. In the data of the rate of hot water shrinkage, minus (−) means shrinkage.

TABLE 4

| characterization of spun yarn | method of examination | drawn wool top sliver of Example 1 | drawn wool top sliver of Comparative Example 1 |
|---|---|---|---|
| contraction in boiling water (%) | JIS-L-1095 A | +0.6% | −3.6% |

When the processing was performed without using the squeezing rollers installed in each of the oxidation bath, the penetration of the hydrogen peroxide solution to wool top sliver and the processing temperature was also as low as 25° C., a blocking effect to —SH group by hydrogen peroxide was not fully acquired. Therefore the set effect was inadequate, and as the result, the fiber diameter was thicker as compared the one obtained in Example 1 and the fiber length was also short. Besides, also in the above-described test spun yarn, it was observed compared with Example 1 that the contraction by boiling water was longer compared with the one of Example 1. Namely, in order to completely fix the form of the fiber after drawing, using 2.8 weight % of hydrogen peroxide aqueous solution at 25° C., it was shown to be essential to circulate through the hydrogen peroxide aqueous solution compulsorily by the liquid displacement effect using the squeezing rollers installed in the baths.

Comparative Example 2

As comparison of Example 1, except for that the temperature of hydrogen peroxide liquid was 80° C. and the squeezing rollers installed in each of the oxidation baths were not used, the processing was performed according to the processing conditions of Example 1. And the sliver was gilled and recombed to obtain the result shown Table 5.

TABLE 5

| | drawn wool top sliver of Example 1 | drawn wool top sliver of Comparative Example 2 |
|---|---|---|
| average fiber diameter (μm) | 15.8 | 15.8 |
| average fiber length (mm) | 93.3 | 85.0 |
| length of longest fiber (mm) | 230 | 220 |
| content of short fiber (≦30 mm) (%) | 12.2 | 15.0 |
| alkali solubility (%) | 21.5 | 29.2 |
| UB solubility (%) | 35.8 | 26.9 |

And the above-described drawn wool top sliver was spun to obtain a yarn with yarn count of 1/30 and twist of Z 440 in the same way as Example 1 and the data of the yarn were shown in Table 6.

TABLE 6

| characterization of spun yarn | method of examination | drawn wool top sliver of Example 1 | drawn wool top sliver of Comparative Example 2 |
|---|---|---|---|
| strength (gf) | JIS-L-1095 | 260.0 | 249.0 |
| elongation (%) | JIS-L-1095 | 12.8 | 11.5 |
| contraction | | | |

TABLE 6-continued

| characterization of spun yarn | method of examination | drawn wool top sliver of Example 1 | drawn wool top sliver of Comparative Example 2 |
|---|---|---|---|
| in boiling water (%) | JIS-L-1095 A | 0.6% | −0.7% |

When the processing was performed at 80° C. without using the squeezing rollers installed in each of the oxidation baths, although the appearance of the fiber after drawing was similar to the drawn wool fiber by Example 1, both the average fiber length and the length of the longest fiber were shorter than those of Example 1. Besides, the increase in amount of short cut fiber was also observed. This result shows that by the oxidation treatment at high temperature, the fiber was embrittled and the short cut fiber was formed in this wool top sliver by gilling and recombing. The alkali solubility and UB solubility with which the degree of damage of fiber is estimated, showed the result that damage of the drawn wool fiber by the processing conditions of Comparative Example 2 is higher as compared with the drawn wool top sliver by Example 1.

Also in the above described tested spun yarn, compared with the yarn obtained using the drawn wool top sliver by Example 1, the strength and the elongation of the yarn obtained using the drawn wool top sliver by the processing conditions of Comparative Example 2 are lower, and the above-described result was supported. That is, in order to obtain drawn wool fiber where the damage on the fiber is suppressed, the hydrogen peroxide aqueous solution of a low temperature is necessary to be compulsorily circulated in the wool fiber sliver, and the oxidation treatment needs to be performed by the squeezing rollers installed in the baths. This fact shows that the squeezing rollers in the baths used in the present invention was an important element in obtaining a drawn wool fiber with little fiber damage.

Example 2

The wool fiber sliver of 37 g/m (1) having an average fiber diameter of 27.0 microns and an average fiber length of 70.0 mm twisted by 16 turns/m using Flyer type twisting machine. This sliver was treated in the same way as Example 1 except the following treating condition.

The Condition Different from Example 1

1) the composition of the treating solution and treating temperature and time for plasticizing and swelling pretreatment bath (5):

| | |
|---|---|
| Sodium bicarbonate | 30 g/l |
| Sodium carbonate | 0.15 g/l |
| Dipping condition | 10 min at 60 |

2) Drawing ratio: 1.7 times (practically drawing ratio: 1.25 times)

3) Without passing through reduction processing bath (17) and omitting the oxidation processing using hydrogen peroxide, the 80° C. hot water was used instead (treating bath: 24, 29, 34).

4) Neuralization processing was conducted at pH 4.5 using acetic acid instead of formic acid in neutralization bath (39).

The fiber obtained has the structure where crimp recovery ability is temporarily fixed. Average fiber diameter and average fiber length before and after treating is shown in Table 7. The mixture of 70% by weight of wool sliver obtained by thin treatment and 30% by weight of 27.0 μm undrawn sliver was spun into 3/4 Nm, and subjected to relaxation treatment by steam. The specific volume of the yarn obtained was measured and the result was shown in Table 8.

TABLE 7

| | undrawn wool top sliver | drawn temporarily set wool top sliver |
|---|---|---|
| average fiber diameter (μm) | 27.7 | 26.1 |
| average fiber length (mm) | 70.0 | 79.8 |
| alkali solubility (%) | 13.0 | 14.0 |
| UB solubility (%) | 50.6 | 48.0 |

TABLE 8

| | drawn temporarily set yarn ¾ Nm after steaming | (reference) ordinary market yarn ¾ Nm after steaming |
|---|---|---|
| specific volume of spun yarn (cc/g) | 15.86 | 9.3 |

In Examples and Comparative Examples described above, alkali solubility and UB solubility of animal fiber were measured based on the testing method described "7.21.1 the alkali solubility" and "7.21.2 the solubility to urea-sodium bisulfate (UB solubility)" in "7.21 the degree of damage of fiber" of JIS-L-1081.

According to the present invention, it is possible that the fiber diameter of an animal fiber can be decreased, the fiber length can be increased, and that the animal fiber is able to be modified to obtain a slenderized fiber without spoiling the crimp property owned originally by natural fiber. Since wool fiber is a natural fiber it has inevitably restrictions in thinness (fiber diameter) and length (fiber length), consequently the manufacturing the spun yarn of a fine yarn count has also been restricted. The present invention in one side enables an industrial manufacturing of a thinner animal fiber by overcoming the above-described restrictions. And on the other hand the present invention enables industrial manufacturing of a slenderized animal fiber providing animal fiber products that has volume with lightweight, a high air-content and a high heat retaining property by adopting a mild condition in drawing, i.e., the set conditions of about a temporary set.

What is claimed is:

1. A method for preparation of a slenderized crimped animal fiber with a fixed slenderized form having a lowering rate of tensile strength for undyed spun yarn of no less than 10%, fiber contraction in boiling water of no more than 1%, an alkali solubility of no more than 22% by weight and a UB solubility of no more than 35% by weight, comprising:

a) a process wherein an actual twist is applied to an animal fiber sliver;

b) a process wherein a twisted animal fiber sliver is swelled and plasticized by a basic aqueous solution and subsequently an anisotropic swelling is given to the animal fiber consisting of a bilateral structure;

c) a reduction process wherein a disulfide bond in the anisotropically swelled and plasticized fiber is cleaved;

d) a drawing process wherein the reduced and anisotropically swelled and plasticized fiber is drawn by practically 1.20 to 1.60 times;

e) a process wherein the drawn animal fiber is oxidized to reproduce a disulfide bond;

f) a process wherein the fiber is neutralized with an acid to be de-swelled;

g) a drying process in an unstretched condition, wherein dipping and squeezing is repeated using at least each three pairs of squeezing rollers provided in each of an oxidation treatment bath, a neutralization treatment bath, and a hot water washing bath installed before the oxidation treatment bath and a hot water washing bath installed after the neutralization treatment bath, and the oxidation treatment is conducted at 15 to 25° C.

2. The method for preparation of the slenderized animal fiber according to claim 1, wherein the anisotropic swelling and plasticization process and reduction process are performed in one process.

3. The method for preparation of the slenderized animal fiber according to claim 2, wherein the anisotropic-swelling plasticization treatment agent is a base selected from a group consisting of a monoethanolamine, a carbonate of alkali metal or ammonium, and bicarbonate of alkali metal or ammonium.

4. The method for preparation of the slenderized animal fiber according to claim 2, wherein the drawing treatment is performed in hot water or in heated steam.

5. The method for preparation of the slenderized animal fiber according to claim 2, wherein the neutralization processing is performed using formic acid.

6. The method for preparation of the slenderized animal fiber according to claim 1, wherein the anisotropic-swelling plasticization treatment agent is a base selected from a group consisting of a monoethanolamine, a carbonate of alkali metal or ammonium, and bicarbonate of alkali metal or ammonium.

7. The method for preparation of the slenderized animal fiber according to claim 1, wherein the reducing agent is selected from a group consisting of a bisulfite of alkali metal or ammonium and a sulfite of alkali metal or ammonium.

8. The method for preparation of the slenderized animal fiber according to claim 1, wherein the drawing treatment is performed in hot water or in heated steam.

9. The method for preparation of the slenderized animal fiber according to claim 1, wherein the oxidation of the drawn animal fiber is performed using hydrogen peroxide.

10. The method for preparation of the slenderized animal fiber according to claim 1, wherein the neutralization processing is performed using formic acid.

11. A method for preparation of a slenderized animal fiber in a state of temporarily fixed slenderized form with a crimp-recovering property by de-swelling treatment with acid and wet heat treatment, having a lowering rate of tensile strength for undyed spun yarn of no less than 10%, completely recover level of fiber contraction in boiling water where the fiber subjected to elongation of 1.20 to 1.30 times recovers the original length, an alkali solubility of no more than 15% by weight and a UB solubility of no more than 40% by weight, comprising:

a) a process wherein a real twist is applied to an animal fiber sliver;

b) a process wherein a twisted animal fiber sliver is swelled and plasticized by a basic aqueous solution and subsequently an anisotropic swelling is given to the animal fiber consisting of a bilateral structure;

c) a reduction process wherein the anisotropically swelled and plasticized fiber is drawn by practically 1.20 to 1.30 times;

d) a process wherein the fiber is neutralized with an acid to be de-swelled;

e) a drying process in a stretched condition, wherein dipping and squeezing is repeated using at least each three pairs of squeezing rollers provided in a neutralization treatment bath and hot water washing baths installed before and after the neutralization treatment bath respectively, and the neutralization treatment is conducted at 15 to 25° C.

12. The method for preparation of the slenderized animal fiber according to claim 11, wherein the anisotropic-swelling plasticization treatment agent is a base selected from a group consisting of a monoethanolamine, a carbonate of alkali metal or ammonium, and bicarbonate of alkali metal or ammonium.

13. The method for preparation of the slenderized animal fiber according to claim 11, wherein the neutralization processing is performed using formic acid.

14. The method for preparation of the slenderized animal fiber according to claim 11, wherein the drawing treatment is performed in hot water or in heated steam.

15. The method for preparation of the slenderized animal fiber according to claim 1 or 11, wherein the anisotropic-swelling plasticization treatment is performed by dipping the twisted animal fiber sliver in a basic aqueous solution of pH 7.6 to 10.5 containing a swelling agent and a plasticization agent for 5 to 40 minutes at 30 to 80° C.

16. The method for preparation of the slenderized animal fiber according to claim 15, wherein the anisotropic-swelling plasticization treatment agent is a base selected from a group consisting of a monoethanolamine, a carbonate of alkali metal or ammonium, and bicarbonate of alkali metal or ammonium.

17. The method for preparation of the slenderized animal fiber according to claim 15, wherein the drawing treatment is performed in hot water or in heated steam.

18. The method for preparation of the slenderized animal fiber according to claim 15, wherein the neutralization processing is performed using formic acid.

19. A method for preparation of a bulky animal fiber spun yarn, wherein a slenderized animal fiber is mixed with un-drawn animal fiber and spun, and then an original length of a temporarily fixed animal fiber is recovered;

the slenderized animal fiber being in a state of temporarily fixed slenderized form with a crimp-recovering property by de-swelling treatment with acid and wet heat treatment, having a lowering rate of tensile strength for undyed spun yarn of no less than 10%, completely recover level of fiber contraction in boiling water where the fiber subjected to elongation of 1.20 to 1.30 times recovers the original length, an alkali solubility of no more than 15% by weight and a UB solubility of no more than 40% by weight; and the slenderized animal fiber being prepared by being drawn by practically 1.20 to 1.30 times after an anisotropic swelling is given to the animal fiber consisting of bilateral structure using swelling plasticization with base.

20. The method of claim 19, wherein the mixed spun yarn is treated with warm or hot water at temperature at 40 to 100° C. or with steam 1 to 2 atmospheric pressure in order to recover an original length.

* * * * *